United States Patent [19]

Liu

[11] Patent Number: 4,731,221

[45] Date of Patent: Mar. 15, 1988

[54] NICKEL ALUMINIDES AND NICKEL-IRON ALUMINIDES FOR USE IN OXIDIZING ENVIRONMENTS

[75] Inventor: Chain T. Liu, Oak Ridge, Tenn.

[73] Assignee: The United States of America as represented by the United States Department of Energy, Washington, D.C.

[21] Appl. No.: 786,562

[22] Filed: Oct. 11, 1985

Related U.S. Application Data

[63] Continuation-in-part of Ser. No. 730,602, May 6, 1985.

[51] Int. Cl.[4] ..... C22C 19/05

[52] U.S. Cl. ..... 420/445; 420/443; 420/446; 420/447; 420/449; 420/455; 420/460

[58] Field of Search ..... 420/445, 443, 446, 447, 420/449, 455, 459, 460; 148/428

[56] References Cited

U.S. PATENT DOCUMENTS 4,478,791 10/1984 Huang et al. ..... 420/445

*Primary Examiner*—R. Dean

*Attorney, Agent, or Firm*—Katherine P. Lovingood; Stephen D. Hamel; Judson F. Hightower

[57] ABSTRACT

Nickel aluminides and nickel-iron aluminides treated with hafnium or zirconium, boron and cerium to which have been added chromium to significantly improve high temperature ductility, creep resistance and oxidation properties in oxidizing environments.

4 Claims, 2 Drawing Figures

NICKEL ALUMINIDES AND NICKEL-IRON ALUMINIDES FOR USE IN OXIDIZING ENVIRONMENTS

This invention relates to nickel aluminides and nickel-iron aluminide alloys that exhibit improved ductility in oxidizing environments at elevated temperatures and is a result of work under a contract with the United States Department of Energy.

BACKGROUND OF THE INVENTION

This patent application is a continuation-in-part of previously filed, co-pending patent application Ser. No. 730,602 filed May 6, 1985.

Ordered intermetallic alloys based on tri-nickel aluminide ($Ni_3Al$) have unique properties that make them attractive for structural applications at elevated temperatures. They exhibit the unusual mechanical behavior of increasing yield stress with increasing temperature whereas in conventional alloys yield stress decreases with temperature. Tri-nickel aluminide is the most important strengthening constituent of commercial nickel-base superalloys and is responsible for their high-temperature strength and creep resistance. The major limitation of the use of such nickel aluminides as engineering materials has been their tendency to exhibit brittle fracture and low ductility.

Recently alloys of this type have been improved by the additions of iron to increase yield strength, boron to increase ductility, and titanium, manganese and niobium for improving cold fabricability (commonly assigned and co-pending U.S. patent application Ser. No. 519,941 filed Aug. 3, 1983, *Ductile Aluminide Alloys for High Temperature Applications,* Liu and Koch). Another improvement has been made to the base $Ni_3Al$ alloy by adding iron and boron for the aforementioned purposes and, in addition, hafnium and zirconium for increased strength at higher temperatures (commonly assigned and co-pending U.S. patent application Ser. No. 564,108 filed Dec. 21, 1983, *Ductile Aluminide Alloys for High Temperature Applications,* Liu and Steigler). Further improvements were made to these alloys by increasing the iron content and also adding a small amount of a rare earth element, such as cerium, to improve fabricability at higher temperatures in the area of 1,200° C., (commonly assigned and co-pending U.S. patent application Ser. No. 730,602 filed May 6, 1985, *High-Temperature Fabricable Nickel-Iron Aluminides,* Liu). These co-pending U.S. patent applications are incorporated herein by reference.

These improved alloys exhibit good tensile ductility at temperatures in the range of about 600° C. when tested in a vacuum. Preoxidation treatment does not strongly effect the tensile ductility of these alloys if the tensile ductility is subsequently tested in a vacuum; however, these same alloys are severely embrittled when tensile tests are done at like temperatures in air or oxygen. This embrittlement is a considerable disadvantage to alloys that are contemplated to be useful in engines, turbines, and other energy conversion systems that are always operated in high-temperature oxidizing conditions. To a certain extent the embrittlement is alleviated if the concentration of aluminum and hafnium is lowered to 22–24 at. % or below and the alloy is preoxidized, but the improvement is limited.

SUMMARY OF THE INVENTION

In view of the above, it is an object of this invention to improve the tensile ductility of nickel aluminide and nickel-iron aluminide alloys at high temperatures and oxidizing environments.

It is another object of this invention to reduce oxygen adsorption and diffusion into grain boundaries when nickel aluminides and nickel-iron aluminides are under stress at high temperatures in oxidizing environments.

Additional objects and advantages will become apparent to those skilled in the art upon examination of the specification and the claims.

To achieve the foregoing and other objects, this invention is a nickel aluminide having the basic composition of $Ni_3Al$ and having a sufficient concentration of a Group IVB element or mixtures of elements to increase high temperature strength, a sufficient concentration of boron to increase ductility in addition to a sufficient concentration of chromium to increase ductility at elevated temperatures in oxidizing environments. The invention is also a nickel-iron aluminide having basically an $Ni_3Al$ base, a sufficient concentration of a Group IVB element or mixtures of these elements to increase high temperature strength, and a sufficient concentration of iron and rare earth element or mixtures of these to increase hot fabricability, a sufficient concentration of boron to increase ductility as well as a sufficient concentration of chromium to increase ductility at elevated temperatures in oxidizing environments. The addition of chromium to these nickel and nickel-iron aluminides results in significant improvement in ductility of these alloys at high temperatures in oxidizing environments. This improvement permits the use of these alloys for components in gas turbines, steam turbines, advanced heat engines and other energy conversion systems.

DESCRIPTION OF THE PREFERRED EMBODIMENT

Figure 1:
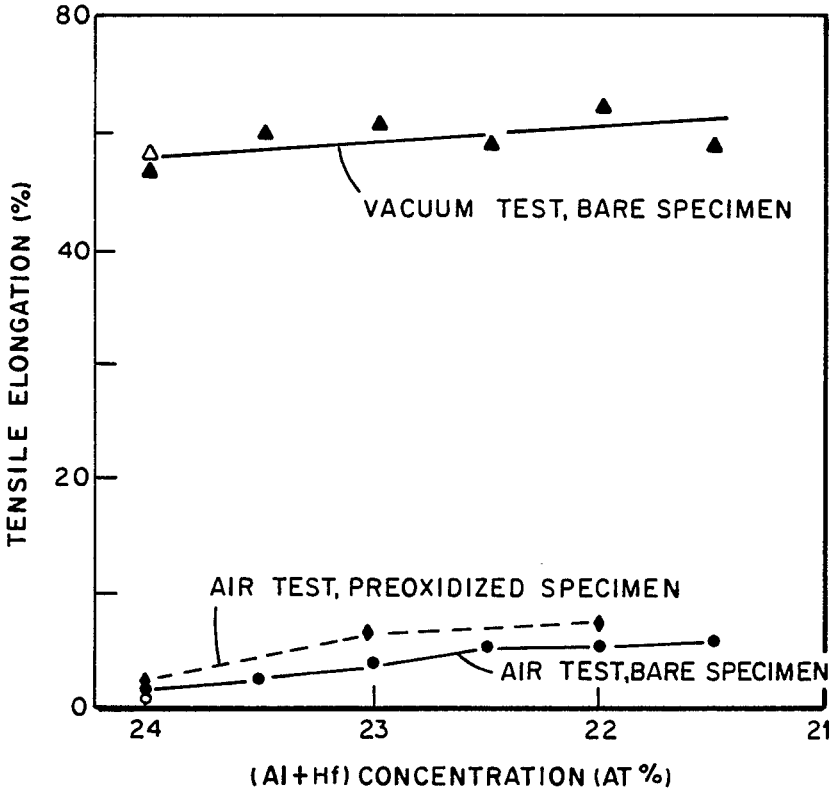
FIG. 1 illustrates graphically the ductility behavior of nickel aluminide alloys tested at 600° C. in a vacuum and in air.

Nickel aluminides and nickel-iron aluminides show good tensile ductilities at elevated temperatures of about 600° C. when tested in a vacuum. However, there is severe embrittlement when tensile ductilities are measured at similar temperatures in the presence of oxygen and air as shown in FIG. 1. The drop in ductility at 600° C. is accompanied by a change in fracture mode from transgranular to intergranular. This embrittlement is quite unusual and is related to a dynamic effect simultaneously involving high stress, high temperature and gaseous oxygen. The dynamic embrittlement can be alleviated to a certain extent by lowering the concentration of aluminum and hafnium from 24 to 22 at. % or below and by preoxidation of the specimens in air, for example, two hours at 1,100° C. and then five hours at 850° C. This alleviation, however, is not completely satisfactory because only a limited improvement in ductility is achieved as shown in FIG. 1.

Nickel aluminides having a base composition of nickel and aluminum in a ratio of approximately 3 parts nickel to 1 part aluminum containing one or more elements from Group IVB of the periodic table to increase high temperature strength and boron to increase ductility exhibited improved high temperature ductility and creep resistance in oxidizing environments by adding an effective amount of chromium. Ternary alloy phase diagrams indicate that the Group IVB elements, hafnium and zirconium atoms occupy "Al" sublattice sites and chromium atoms occupy equally on both "Al" and "Ni" sublattice sites in the ordered $Ni_3Al$ crystal structure. The equivalent aluminum content in aluminides is thus defined as Al %+Hf (or Zr)% +Cr %/2. In otherwords, only half the amount of chromium atoms is considered chemically as aluminum atoms in the $Ni_3Al$ alloys.

EXAMPLE 1

A series of alloys were prepared based on the intermetallic alloy $Ni_3Al$ containing selected components to improve high temperature strength, ductility and hot fabricability. all the alloys were prepared by arc melting and drop casting into ½"×1"×5" copper mold. Chromium in varying amounts was added to certain other melts to improve the elevated temperature ductility of the alloys in air. No element other than chromium has been found to improve the elevated temperature ductility of these alloys in air or oxygen.

Table I lists the compositions of several chromium-modified nickel aluminide compositions prepared for evaluation.

TABLE I

Composition of nickel aluminides modified with chromium additions

| Alloy number | Composition (at. %)[a] | Cold Fabrication |
|---|---|---|
| | Alloys containing no Cr | |
| IC-137 | Ni—22.5 Al—0.5 Hf | Good |
| IC-154 | Ni—22.0 Al—1.0 Hf | Good |
| IC-145 | Ni—21.5 Al—0.5 Hf | Good |
| IC-188 | Ni—21.5 Al—0.5 Zr | Good |
| IC-191 | Ni—21.0 Al—0.5 Hf | Good |
| IC-192 | Ni—20.7 Al—0.4 Hf | Good |
| IC-190 | Ni—20.5 Al—1.5 Hf | Good |
| | Alloys containing 1.5-2.0 at. % Cr | |
| IC-201 | Ni—21.3 Al—1.0 Hf—1.5 Cr | Poor |
| IC-203 | Ni—19.8 Al—1.5 Hf—1.5 Cr | Good |
| IC-209 | Ni—19.0 Al—1.5 Hf—1.5 Cr | Good |
| IC-228 | Ni—19.7 Al—0.4 Hf—2.0 Cr | Good |
| IC-231 | Ni—19.1 Al—1.0 Zr—2.0 Cr | Good |
| IC-234 | Ni—18.6 Al—1.5 Zr—2.0 Cr | Fair |
| | Alloys containing 3.0-4.0 at. % Cr | |
| IC-210 | Ni—18.5 Al—1.5 Hf—3.0 Cr | Fair |
| IC-229 | Ni—18.7 Al—0.4 Hf—4.0 Cr | Good |
| IC-232 | Ni—18.1 Al—1.0 Zr—4.0 Cr | Good |
| IC-235 | Ni—17.6 Al—1.5 Zr—4.0 Cr | Fair/Poor |
| | Alloys containing 6.0 at. % Cr | |
| IC-181 | Ni—19.5 Al—0.5 Hf—6.0 Cr | Fair/Poor |
| IC-193 | Ni—18.5 Al—0.5 Hf—6.0 Cr | Fair/Poor |
| IC-211 | Ni—17.5 Al—1.5 Hf—6.0 Cr | Fair |
| IC-194 | Ni—17.5 Al—0.5 Hf—6.0 Cr | Good |
| IC-226 | Ni—17.5 Al—0.5 Zr—6.0 Cr | Good |
| | Alloys containing 8.0 at. % Cr | |
| IC-213 | Ni—16.5 Al—1.5 Hf—8.0 Cr | Poor |
| IC-214 | Ni—16.5 Al—1.5 Zr—8.0 Cr | Poor |
| IC-218 | Ni—16.7 Al—0.4 Zr—8.0 Cr | Good |
| IC-219 | Ni—16.7 Al—0.4 Hf—8.0 Cr | Good |
| IC-221 | Ni—16.1 Al—1.0 Zr—8.0 Cr | Good/Fair |
| IC-223 | Ni—15.6 Al—1.5 Zr—8.0 Cr | Poor |

[a]All alloys contain 0.1 at. % B.

All alloys were doped with 0.1 at. % boron for control of grain boundary cohesion. The cold fabricability of nickel aluminides was determined by repeated cold rolling or forging with intermediate anneals at 1,000° to 1,050° C. in vacuum. As indicated in Table I, the cold fabricability is affected by aluminum, hafnium and chromium concentrations. In general the fabricability, both cold and hot, is affected by aluminum, hafnium and chromium concentrations decreasing with increasing concentrations of aluminum, hafnium and chromium. Good cold fabricability was achieved in the alloys with the composition range of from 20 to 17 at. % aluminum, 0.4 to 1.5 at. % hafnium or zirconium, 1.5 to 8 at. % chromium balanced with nickel. The equivalent aluminum content in the alloys is less than 22% for best results. Hot fabrication of these alloys was not as successful.

Hot fabricability of nickel aluminides is determined by forging or rolling at 1,000° to 1,100° C. Limited results indicate that the aluminides containing less than 21.5% aluminum and hafnium can be successfully forged at 1,000° to 1,100° C. The ability to hot forge appears to decrease with increasing chromium in the aluminides having the same aluminum equivalent concentrations. The aluminides with 6% chromium or more become difficult to hot fabricate. Hot fabricability is improved by initial cold forging followed by recrystallization treatment for control of grain structure.

Tensile properties of the cold fabricated nickel aluminides were determined on an INSTRON testing machine in air at temperatures to 1,000° C. Table II shows the effect of chromium additions on tensile properties at 600° C.

TABLE II

Comparison of 600° C. tensile properties of nickel aluminides with and without chromium tested in air

| Alloy Number | Composition[a] (at. %) | Elongation (%) | Yield Stress (ksi) | Tensile Strength (ksi) |
|---|---|---|---|---|
| | Alloys containing 23 at. % Al and its equivalent[b] | | | |
| IC-137 | Ni—22.5 Al—0.5 Hf | 3.4 | 93.2 | 97.6 |
| IC-181 | Ni—19.5 Al—0.5 Hf—6.0 Cr | 9.4 | 90.3 | 119.5 |
| | Alloys containing 22 at. % Al and its equivalent[b] | | | |
| IC-190 | Ni—20.5 Al—1.5 Hf | 3.8 | 128.5 | 135.6 |
| Ic-203 | Ni—19.8 Al—1.5 Hf—1.5 Cr | 5.7 | 120.4 | 132.3 |
| | Alloys containing 21.0-21.1 at. % Al and its equivalent[b] | | | |
| IC-192 | Ni—20.7 Al—0.4 Hf | 6.3 | 98.7 | 124.1 |
| IC-194 | Ni—17.5 Al—0.5 Hf—6.0 Cr | 13.7 | 92.8 | 122.4 |
| IC-218 | Ni—16.7 Al—0.4 Zr—8.0 Cr | 26.5 | 104.2 | 154.0 |

[a]Alloys contain 0.1 at. % B.
[b]Atomic percent of Al and its equivalent is defined as (Al % + Hf % + Cr %/2).

The ductility of chromium containing alloys is significantly higher than that of the alloys containing no chromium. Also the results indicate that the beneficial effect of chromium increases with its content in the aluminides. The yield stress and tensile strengths appear not to be strongly affected by chromium additions.

Figure 2:
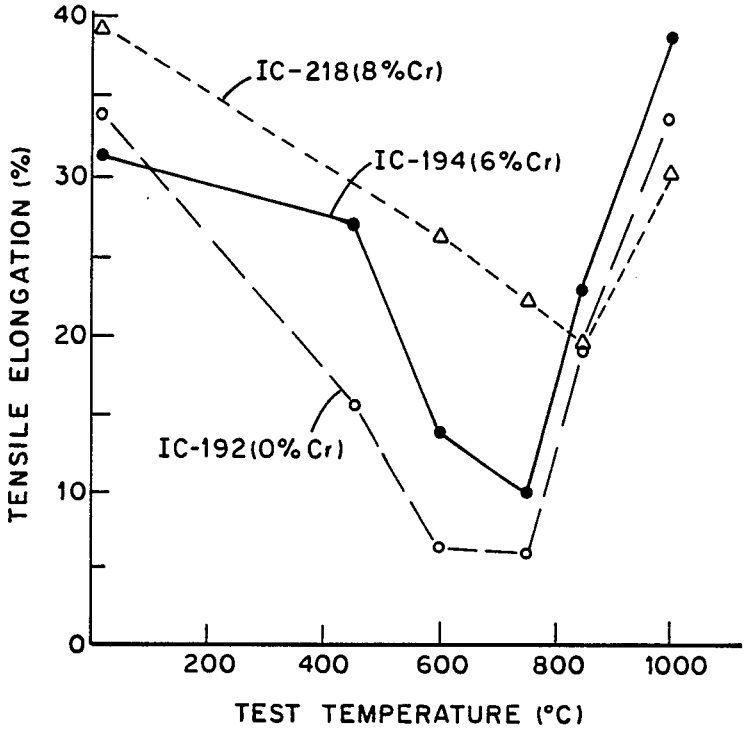
FIG. 2 is a plot of tensile elongation as a function of temperature for nickel aluminide alloys with and without the addition of chromium.

FIG. 2 is a plot of tensile elongation as a function of test temperature for IC-192 containing no chromium, IC-194 containing 6 at. % chromium, and IC-218 containing 8 at. % chromium. All alloys show a decrease in ductility with temperature and reach ductility minimum at about 700° to 850° C. Above this temperature the ductility of all alloys increases sharply and reaches about 30% at 1,000° C. As shown in FIG. 2, the ductility of the chromium-containing alloys is much better than that of the alloy without chromium at elevated temperatures. Particularly at temperatures at from 400° to 800° C. The beneficial effect of chromium addition is believed to be related to the fact that the chromium oxide film slows down the process of oxygen adsorption and diffusion down grain boundaries during tensile tests at elevated temperatures when grain boundaries are under high stress concentrations.

Creep properties of the aluminides were determined at 700° C. and 40 ksi in a vacuum. The results are shown in Table III.

TABLE III

Comparison of creep properties of nickel aluminides with and without Cr tested at 760° C. and 40 ksi in vacuum

| Alloy Number | Composition[a] (at. %) | Rupture Life (h) |
|---|---|---|
| | Alloys containing 22 at. % Al and its equivalent[b] | |
| IC-190 | Ni—20.5 Al—1.5 Hf | 143 |
| IC-203 | Ni—19.8 Al—1.5 Hf—1.5 Cr | 318 |
| | Alloys containing 21.0–21.1 at. % Al and its equivalent[b] | |
| IC-192 | Ni—20.7 Al—0.4 Hf | 64 |
| IC-194 | Ni—17.5 Al—0.5 Hf—6.0 Cr | 282 |
| IC-218 | Ni—16.7 Al—0.4 Zr—8.0 Cr | >400[c] |
| IC-221 | Ni—16.1 Al—1.0 Zr—8.0 Cr | >1,000[c] |

[a]Alloys contain 0.1 at. % B.
[b]Defined as (Al % + Hf % + Cr %/2).
[c]The test was stopped without rupture of the specimen.

Surprisingly, alloying from 1.5 to 8 at. % chromium substantially increases the rupture life of nickel aluminides.

Air oxidation resistance of aluminides was evaluated by exposure of sheet specimens to air at 800° and 1,000° C. The results are shown in Table IV for IC-192 with no chromium, IC-194 with 6 at. % chromium and IC-218 with 8 at. % chromium.

TABLE IV

Comparison of oxidation behavior of nickel aluminides with and without Cr, exposed to air for 360 h

| Alloy Number | Composition (at. %)[a] | Wt gain ($10^{-4}$ g/cm$^2$) | Remark |
|---|---|---|---|
| | 800° C. oxidation | | |
| IC-192 | Ni—20.7 Al—0.4 Hf | 17.5 | No spalling |
| IC-194 | Ni—17.5 Al—0.5 Hf—6.0 Cr | 2.0 | No spalling |
| IC-218 | Ni—16.7 Al—0.4 Zr—8.0 Cr | 1.5 | No spalling |
| | 1,000° C. oxidation | | |
| IC-192 | Ni—20.7 Al—0.4 Hf | 9.9 | No spalling |
| IC-194 | Ni—17.5 Al—0.5 Hf—6.0 Cr | 8.8 | No spalling |

[a]Alloys contain 0.1 at. % B.

Chromium addition has a small effect on oxidation rate at 1,000° C. but substantially lowers the rate at 800° C. Beneficial effect of chromium is due to its rapid formation of chromium oxide film which protects the base metal from excessive oxidation. Although aluminum also can form an oxide film, aluminum oxide is not formed as rapidly as the formation of chromium oxide.

EXAMPLE II

Chromium additions were made to nickel-iron aluminides to improve their ductility at intermediate temperatures of from 400° to 800° C. Table V is a list of alloy compositions based on IC-159 which was modified with up to 7 at. % chromium. A small amount of carbon can be added to further control the grain structure in these alloy ingots.

TABLE V

Composition of Ni—Fe aluminides based on IC-159, modified with Cr additions

| Alloy Number | Composition (at. %)[a] |
|---|---|
| IC-159 | Ni—15.5 Fe—19.75 Al—0.25 Hf |
| IC-165 | Ni—15.5 Fe—19.75 Al—0.25 Zr |
| IC-197 | Ni—15.5 Fe—19.75 Al—0.25 Zr—1.5 Cr |
| IC-167 | Ni—15.5 Fe—19.75 Al—0.25 Zr—3.0 Cr |

TABLE V-continued

Composition of Ni—Fe aluminides based on IC-159, modified with Cr additions

| Alloy Number | Composition (at. %)[a] |
|---|---|
| IC-237 | Ni—14.0 Fe—19.5 Al—0.2 Hf—3.0 Cr |
| IC-236 | Ni—13.0 Fe—19.5 Al—0.2 Hf—3.0 Cr |
| IC-205 | Ni—12.5 Fe—19.75 Al—0.25 Zr—3.0 Cr |
| IC-238 | Ni—12.0 Fe—19.5 Al—0.2 Hf—3.0 Cr |
| IC-199 | Ni—15.5 Fe—17.75 Al—0.25 Zr—6.0 Cr |
| IC-206 | Ni—9.5 Fe—19.75 Al—0.25 Zr—6.0 Cr |
| IC-168 | Ni—15.5 Fe—19.75 Al—0.25 Zr—7.0 Cr |

[a]All alloys contain 0.002 at. % Ce, 0.07 at. % B, and 0. to 0.1 at. % C.

All alloys were prepared by arc melting and drop casting. Sheet materials were produced by either hot fabrication at 1,050° to 1,200° C. or repeated cold work with intermediate anneals and 1,050° C. Table VI compares the tensile properties of IC-159 without chromium and IC-167 with 3 at. % chromium.

TABLE VI

Comparison of tensile properties of IC-159 (no Cr) and IC-167 (3.0% Cr) tested in air

| Alloy Number | Elongation (%) | Yield Stress (ksi) | Tensile Strength (ksi) |
|---|---|---|---|
| | | Room temperature | |
| IC-159 | 40.3 | 77.4 | 194.7 |
| IC-167 | 28.0 | 89.7 | 203.2 |
| | | 600° C. | |
| IC-159 | 3.4 | 94.0 | 106.8 |
| IC-167 | 22.9 | 99.7 | 139.8 |
| | | 760° C. | |
| IC-159 | 0.4 | 73.0 | 73.0 |
| IC-167 | 28.2 | 85.2 | 96.2 |
| | | 850° C. | |
| IC-159 | 38.8 | 55.0 | 58.3 |
| IC-167 | 27.1 | 52.3 | 59.0 |
| | | 1,000° C. | |
| IC-159 | 58.8 | 22.7 | 26.5 |
| IC-167 | 61.0 | 14.9 | 17.2 |

Chromium addition substantially improves the ductility of IC-159 at 600° and 760° C. In fact, alloying with 3 at. % chromium increases the ductility from 0.4% to 28.2% at 760° C. Both alloys, with and without chromium, exhibit good ductilities at higher temperatures in the range of 1,000° C. The chromium addition strengthens IC-159 at temperature to about 800° C. but weakens it at higher temperatures.

In summary, alloying with chromium additions from 1.5 to 8 at. % in nickel aluminides and nickel-iron aluminides substantially increases their ductility at intermediate temperatures from 400° to 800° C. Chromium additions also substantially improve creep properties and oxidation resistance of the nickel aluminides.

I claim:

1. A nickel aluminide consisting essentially of:
   - a $Ni_3Al$ base;
   - a sufficient concentration of a Group IVB element or mixtures thereof to increase high temperature strength;
   - a sufficient concentration of boron to increase ductility; and
   - a sufficient concentration of chromium to increase ductility at elevated temperatures in oxidizing environments.

2. The nickel aluminide of claim 1 wherein said Group IVB element is zirconium, hafnium or mixtures thereof, and is present in concentrations of from 0.2 to 1.5 at. %, aluminum is present in concentrations of from 17 to 20 at. %, chromium is present from 1.5 to 8 at. %, boron is present from 0.05 to 0.2 at. %, and the balance is nickel.

3. A nickel-iron aluminide consisting essentially of:

a $Ni_3Al$ base;

a sufficient concentration of a Group IVB element or mixtures thereof to increase high temperature strength;

a sufficient concentration of material selected from the group consisting of iron and a rare earth element or mixtures thereof to increase hot fabricability;

a sufficient concentration of boron to increase ductility; and a sufficient concentration of chromium to increase ductility at elevated temperatures in oxidizing environments.

4. The nickel-iron aluminide of claim 3 wherein said Group IVB element is zirconium, hafnium or mixtures thereof and is present in concentrations of from 0.1 to 1.0 at. %, aluminum is present in concentrations of from 17 to 20 at. %, iron is present in concentrations of from 9 to 16 at. %, chromium is present in concentrations of from 1.5 to 8 at. %, boron is present in concentrations from 0.05 to 0.2 at. %, said rare earth is cerium and is present in concentrations of from 0.001 to 0.004 at. %, and the balance nickel.

* * * * *